US009074394B2

(12) United States Patent
Rolland

(10) Patent No.: US 9,074,394 B2
(45) Date of Patent: Jul. 7, 2015

(54) HOUSING WITH REAR FACE INTENDED TO BE FIXED TO A SUPPORT

(75) Inventor: Patrick Rolland, Rueil Malmaison (FR)

(73) Assignee: SAGEMCOM ENERGY & TELECOM SAS, Rueil Malmaison (FR)

( * ) Notice: Subject to any disclaimer, the term of this patent is extended or adjusted under 35 U.S.C. 154(b) by 261 days.

(21) Appl. No.: 13/579,833

(22) PCT Filed: Feb. 21, 2011

(86) PCT No.: PCT/EP2011/000821

§ 371 (c)(1), (2), (4) Date: Aug. 17, 2012

(87) PCT Pub. No.: WO2011/103990

PCT Pub. Date: Sep. 1, 2011

(65) Prior Publication Data

US 2012/0312819 A1 Dec. 13, 2012

(30) Foreign Application Priority Data

Feb. 26, 2010 (FR) ..... 1051408

(51) Int. Cl.

| | |
|---|---|
| ***E05B 65/06*** | (2006.01) |
| ***E05C 3/04*** | (2006.01) |
| ***E05B 17/20*** | (2006.01) |
| *E05B 35/00* | (2006.01) |

(52) U.S. Cl.

CPC ..... *E05C 3/042* (2013.01); *E05B 17/2019* (2013.01); *E05B 35/008* (2013.01)

(58) Field of Classification Search

CPC ..... H02G 3/14; H02G 3/088; H02G 3/086; H02G 3/081; H02G 3/08; E05B 65/06

USPC ..... 220/3.7; 70/69–71, 73, 85, 86, 136, 139

See application file for complete search history.

(56) References Cited

U.S. PATENT DOCUMENTS 3,740,979 A * 6/1973 Crepinsek ..... 70/139
4,468,940 A * 9/1984 Davis ..... 70/63

FOREIGN PATENT DOCUMENTS

| | | | |
|---|---|---|---|
| CH | 571 800 | A5 | 1/1976 |
| DE | 30 48 633 | A1 | 7/1982 |
| DE | 10 2004 028223 | A1 | 8/2005 |
| FR | 2 514 224 | A1 | 4/1983 |

* cited by examiner

*Primary Examiner* — Anthony Stashick
*Assistant Examiner* — Raven Collins
(74) *Attorney, Agent, or Firm* — Muncy, Geissler, Olds & Lowe, P.C.

(57) ABSTRACT

Equipment comprising a box (14) having a rear face (15) including a setback (19) that is for releasably receiving a fastening support and that is fitted with a catch (2) that is movable between a position in which it projects into the setback (19) and a retracted position, wherein the catch is secured to a first end of a rod (3) that has a second end (10) visible in the front face (18) of the box and that is mounted in the box (14) to pivot so as to drive the catch (2) between its two positions.

14 Claims, 2 Drawing Sheets

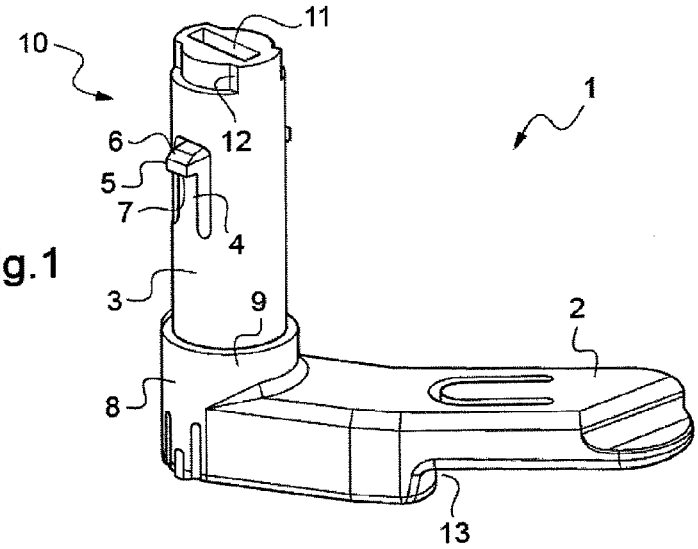
Fig.1
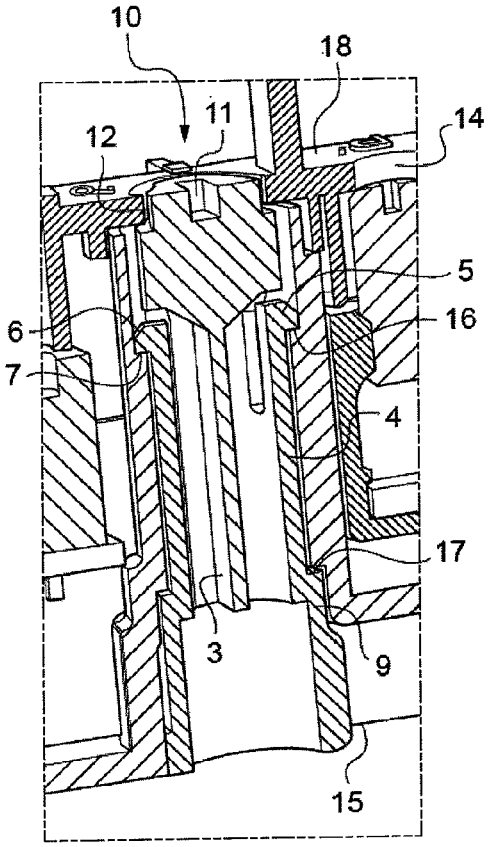
Fig.2
Fig.3
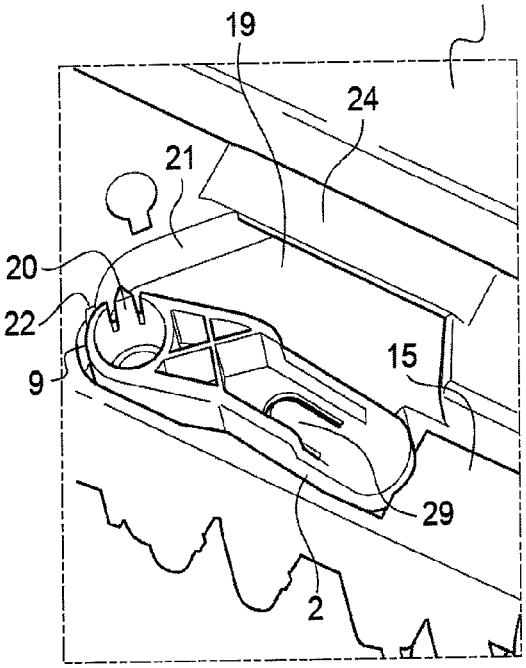

HOUSING WITH REAR FACE INTENDED TO BE FIXED TO A SUPPORT

The present invention relates to equipment comprising a box designed to be fastened to a support by a movable locking device that is operable from the front of the box.

BACKGROUND OF THE INVENTION

Electricity meters are known in the prior art that have a box with a rear face presenting a housing that is arranged to receive a support and that is provided with a locking device for locking the box and for acting in complementary manner on the support to which the box is fastened. By way of example, the support may be a standardized rail of channel section having flanges presenting longitudinal setbacks in the vicinities of their free edges. The locking device generally comprises a catch in the form of a tongue that is mounted to slide against the rear face of the box between a position in which it projects into the housing and a retracted position. The tongue is provided with resilient strips for urging the tongue into the projecting position and it possesses an opposite end projecting laterally from the box in order to enable the tongue to be moved between its two positions.

That solution presents several drawbacks, and the main drawback is that it does not make it simple to access the locking device as a result of electric cables passing close to the end of the tongue that needs to be manipulated. In addition, it does not enable the operator to observe by means of a visual or other marker the position of the catch or whether or not the module is properly held in position, should that be necessary. Finally, manipulating the tongue in order to bring it into the retracted position requires a considerable amount of force and runs the risk of leading to the tongue being damaged.

OBJECT OF THE INVENTION

The object of the invention is thus to propose a locking device for any equipment or module that is to be mounted on a support such as a DIN rail, which locking device remedies the above-mentioned drawbacks, at least in part.

BRIEF SUMMARY OF THE INVENTION

To this end, the invention provides equipment comprising a box having a rear face including a setback that is for releasably receiving a fastening support and that is fitted with a catch that is movable between a position in which it projects into the setback and a retracted position. The catch is secured to a first end of a rod that has a second end visible in the front face of the box and that is mounted in the box to pivot so as to drive the catch between its two positions. The equipment includes friction means for opposing pivoting of the catch.

The rod, secured to the catch, and passing through the box serves to give access to the catch and in particular to enable its position to be adjusted so that it projects into the housing or so that it occupies its retracted position by acting on the second end of the rod that is visible in the front face of the box. The cables therefore do not interfere with actuating the catch.

BRIEF DESCRIPTION OF THE DRAWINGS

Other characteristics and advantages of the invention appear on reading the following description of particular, non-limiting embodiments of the invention.

Reference is made to the accompanying drawings, in which:

FIG. 1 is a perspective view of a catch of the invention;

FIG. 2 is an axial section view of a rod of the catch of FIG. 1, arranged in a box;

FIG. 3 is a perspective view of a rear face of the box fitted with the catch shown in the retracted position;

DETAILED DESCRIPTION OF THE INVENTION

Figure 4:
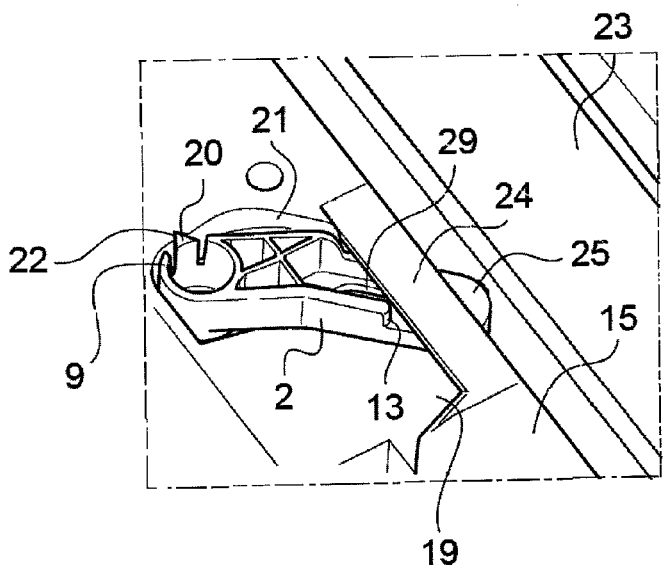
FIG. 4 is a perspective view of the rear face of the box fitted with the catch in the locked position.

The invention described herein relates to an electricity meter comprising a box having a rear face provided with a setback that is to receive releasably a fastener support and that is fitted with a device for locking the box on the support by opposing any extraction of the support from the housing.

FIG. 1 shows the locking device 1 comprising a catch 2 and a rod 3.

The rod 3 has two resilient arms 4 arranged on either side of the rod 3. Each arm has a free end provided with a projecting lug 5, each lug 5 presenting a substantially inclined surface 6 and a radial surface 7 perpendicular to the rod 3. A first end 8 of the rod 3 is inserted in a housing 9 arranged in the catch 2 provided for this purpose. The second end 10 of the rod 3 is provided with a socket 11 and with a cylindrical side surface having a lateral projection defining abutments 12.

The catch 2 is of a special shape, being slightly curved, and it is provided with a shoulder 13 explained below.

The locking device 1 as shown may be made as a single piece or by assembling the first end 8 of the rod 3 in the housing 9 of the catch 2 provided for this purpose. Under such circumstances, the rod 3 may be engaged as a force fit in the housing 9 or it may be connected to the housing 9 of the catch 2 by adhesive or by heat-sealing.

FIG. 2 shows the location occupied by the rod 3 within the box 14. The box 14 includes a housing receiving the rod 3 so that it is free to turn. The housing is defined laterally by a wall of shape complementary to the shape of the lateral surface of the rod and it possesses abutment-forming shoulders 16, 17 co-operating respectively with the rear faces of the lugs 5 and with the top margins of the housing 9 of the catch 2 so as to prevent the rod 3 from moving axially in said housing. The rod 3 is inserted in the housing via the rear face 15 of the box. Inserting the rod 3 deforms the resilient arms 4 until the radial surfaces 7 of the lugs 5 come to bear behind the abutments 16, and the top margins of the housing 9 of the catch 2 come to bear against the abutments 17. The substantially sloping surfaces 6 of the lugs 5 enable the rod 3 to be inserted in the housing in the box, in particular when these substantially inclined surfaces 6 encounter the abutments 17.

When positioned in this way, the rod 3 is securely held axially in the housing in the box 14, and the second end 10 of the rod 3 lies in an orifice formed in the front face 18 of the box 14, thereby enabling the rod 3 to be turned. The second end 10 of the rod 3 constitutes means for controlling the catch 2. The socket 11 is arranged to receive a tool, e.g. a screwdriver, serving to exert a turning force on the rod 3 to turn it about its axis, the turning movement being transmitted to the catch 2. The orifice includes a notch receiving the projection with angular clearance so as to allow the rod to turn through an angle, the abutments 12 coming into contact with the lateral edges of the notch.

FIGS. 3 and 4 show the rear face 15 of the box 14 fitted with the catch 2.

In particular, FIG. 3 shows the catch 2 in a retracted position. The portion of the rear face 15 of the box 14 in which the catch 2 moves is situated in a setback 19 of depth equal to the thickness of the catch 2 so that the catch 2 is flush with the rear face 15.

The housing 9 of the catch 2 in which the rod 3 is located also includes, on its margin, a resilient arm 20 forming a portion in relief that projects laterally from the outside of the margin of the housing 9.

The setback 19 suitable for receiving the catch 2 over its entire stroke is defined by a wall 21 in which a notch 22 is provided to receive the portion in relief of the arm 20, when the catch is in the locked position. In the embodiment shown, the resilient arm 20 is received in the notch 22 by deformation. Thus, the arm 20 rubs against the walls of the notch 22 in order to be placed therein, thus making it possible by friction to oppose pivoting of the catch 2.

Furthermore, FIG. 3 shows a support 23 on which the box 14 is held, and reinforcement 24 flush with the rear face 15 of the box 14 and subjected to stress when the catch 2 is located beneath it.

Moving the catch 2 from its retracted position as shown in FIG. 3 to the locking position, as shown in FIG. 4 thus enables the box 14 to be held on its support 23. The catch 2 is then in a position projecting into the setback 19, the free end 25 of the catch 2 then holding the support 23 by engaging in a cavity of said support.

In order to avoid any breakage of the catch 2, of the rod 3, or merely any possibility of the locking device 1 being torn out from the housing of the box 14, a portion of the catch 2, when in the locked position, is received between the end wall of the setback 19 and the reinforcement 24. Thus, in the event of a force being applied against retention of the box, the immediately adjacent portion of the shoulder 13 of the catch 2 comes to bear against the support 23, thereby ensuring that the box is securely held on its support 23. It should be observed that the axial force exerted by the operator on the catch while it is being turned is taken up in full by the circular portion of the cylinder of the catch that bears against the panel carrying the DIN rail. For this purpose, and advantageously, the cylinder of the catch (in which the housing receiving the rod is formed) may be designed to extend so as to project downwards from the catch. In order to avoid said force being taken up by the resilient arm 4, care should be taken that the distance between the radial faces 7 and said bottom circular portion is less than the distance between the abutment-forming shoulder 16 and the rear face of the box. This ensures that when the box is pressed against the panel or the wall fitted with the support, the bottom portion of the cylinder of the catch does indeed bear against said panel or wall.

The catch 2 is also held in position by the portion in relief of the resilient arm 20 being received in the notch 22 by elastic deformation of said arm, thereby providing an additional degree of security. It should be observed that in the locking position, no plastics-material part is subjected to mechanical stress.

It should be observed that the catch advantageously includes a face 29 facing the rear face of the box, which face 29 is provided with a projecting portion in relief that rubs against the rear face of the box, here the end wall of the setback 19, so as to provide friction opposing movement of the catch.

Figure 5:
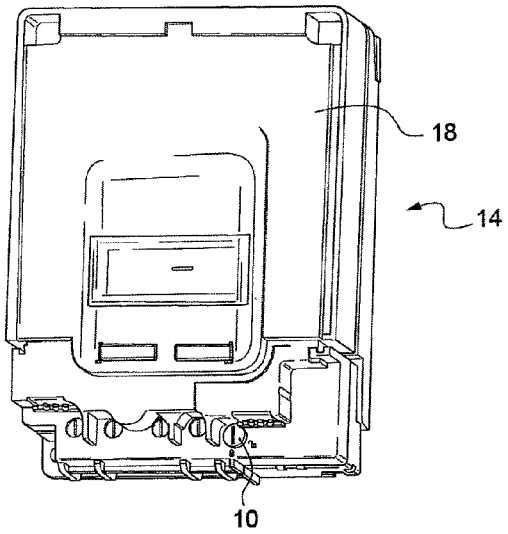
FIG. 5 is a front view of the box.
Figure 6:
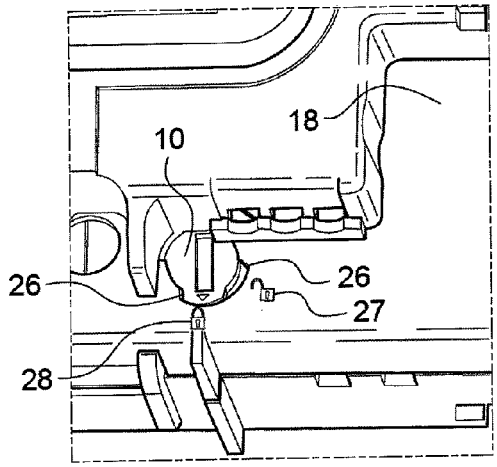
FIG. 6 is a view showing a portion of FIG. 5 on a larger scale in the vicinity of the end of the rod.

FIGS. 5 and 6 show the front face 18 of the box 14 in which the free end 10 of the rod 3 can be seen.

In FIG. 6, which is an enlarged view of the front face 18 of the box 14 including the free end 10 of the rod 3, the abutments 26 formed by the edges of the notch can be seen more clearly, which abutments co-operate with complementary abutments 12 at the end 10 of the rod 3.

Furthermore, indications 27 and 28 are molded, printed, etched, or stuck on the front face 18 of the box 14 close to the abutments 26 so as to show the positions of the projection, depending on whether the catch is in the retracted position (indication 27) or in the locked position (indication 28).

Naturally, the invention is not limited to the embodiments described above that may be subjected to variants that appear to the person skilled in the art without going beyond the ambit of the invention as defined by the claims.

In particular, although the invention is described in application to an electricity meter, the invention is applicable to any equipment that is designed to be mounted on a support, such as a DIN rail, that is fastened to a wall or the like.

What is claimed is:

1. Equipment, comprising:

a box having a rear face including a setback that is for releasably receiving a fastening support and that is fitted with a catch that is movable between a position in which it projects into the setback and a retracted position, the catch is secured to a first end of a rod that has a second end visible in the front face of the box and that is mounted in the box to pivot so as to drive the catch between its two positions, wherein the equipment includes friction means for opposing pivoting of the catch, and wherein the catch includes a face facing the rear face of the box, the face being provided with a projecting portion in relief rubbing against the rear face of the box.

2. The equipment according to claim 1, wherein the rod of the catch is clipped in the box.

3. The equipment according to claim 2, wherein the rod is held in position by at least two resilient arms arranged on either side of the rod, which arms are provided with laterally-projecting portions in relief for coming to bear behind a shoulder of the box.

4. The equipment according to claim 1, wherein the rod is inserted into the box via a rear face of the box.

5. The equipment according to claim 4, wherein the second end is pivotally received in an opening formed in a front face of the box and co-operates with an edge of the opening in order to define an angular stroke for the rod.

6. The equipment according to claim 5, wherein the second end is provided with a laterally-projecting lug and the opening includes a step for receiving the lug while allowing the second end to pivot through an angle.

7. The equipment according to claim 2, wherein the catch in its position projecting into a housing is held in position on an axis parallel to the rod by reinforcement secured to the rear face of the box.

8. The equipment according to claim 4, wherein the extent through which the catch can turn is limited by an abutment defined on the front face of the box.

9. The equipment according to claim 5, including means for holding the catch in the projecting position.

10. The equipment according to claim 9, wherein the means for holding the catch in the projecting position comprise elements of complementary shapes bearing in elastic engagement.

11. The equipment according to claim 10, wherein a resilient blade provided with a portion in relief is defined in the catch, the box including a recess for receiving the portion in relief when the catch is in the projecting position.

12. The equipment according to claim 1, wherein the portion in relief is secured to a resilient blade defined in the face of the catch.

13. The equipment according to claim 3, wherein the box has a front face that incorporates an indicator for indicating the position of the catch.

14. The equipment according to claim 1, wherein the rod and the catch are made as a single piece.

* * * * *